US011837060B2

(12) United States Patent
Saupe et al.

(10) Patent No.: US 11,837,060 B2
(45) Date of Patent: Dec. 5, 2023

(54) SYSTEMS AND METHODS FOR CONTACTLESS PICKUP AT A VENDING MACHINE

(71) Applicant: ROMAINE EMPIRE, INC., Chicago, IL (US)

(72) Inventors: Arne Saupe, Chicago, IL (US); Jovana Florus, Chicago, IL (US); Dawid Wincenty Liszkiewicz, Glen Ellyn, IL (US); Vismaya Shailaja-Panchasheelan, Chicago, IL (US); Benjamin Ephraim Bernays, Evanston, IL (US); Juan Pablo Verdejo Jorquera, Chicago, IL (US); Katelyn Anisa Schneider, Chicago, IL (US)

(73) Assignee: ROMAINE EMPIRE, INC., Chicago, IL (US)

( * ) Notice: Subject to any disclaimer, the term of this patent is extended or adjusted under 35 U.S.C. 154(b) by 152 days.

(21) Appl. No.: 17/369,178

(22) Filed: Jul. 7, 2021

(65) Prior Publication Data

US 2022/0012976 A1 Jan. 13, 2022

Related U.S. Application Data

(60) Provisional application No. 63/048,960, filed on Jul. 7, 2020.

(51) Int. Cl.

*G07F 9/00* (2006.01)
*G07F 9/02* (2006.01)

(52) U.S. Cl.

CPC ..... *G07F 9/026* (2013.01); *G07F 9/001* (2020.05); *G07F 9/002* (2020.05); *G07F 9/006* (2013.01); *G07F 9/023* (2013.01)

(58) Field of Classification Search

CPC ..... G07F 9/001; G07F 9/002; G07F 9/006
See application file for complete search history.

(56) References Cited

U.S. PATENT DOCUMENTS

| | | | | |
|---|---|---|---|---|
| 7,366,586 | B2 * | 4/2008 | Kaplan | G06Q 10/087 221/17 |
| 9,240,007 | B2 * | 1/2016 | Barragán | G06Q 20/18 |
| 9,898,884 | B1 * | 2/2018 | Arora | G06Q 30/0226 |
| 2011/0244798 | A1 * | 10/2011 | Daigle | G06Q 30/0226 455/41.2 |
| 2012/0029691 | A1 * | 2/2012 | Mockus | G07F 9/023 700/231 |
| 2015/0082243 | A1 * | 3/2015 | Taylor | G06F 3/0482 715/814 |
| 2019/0244465 | A1 * | 8/2019 | Saunders | G06Q 20/18 |

* cited by examiner

*Primary Examiner* — Timothy R Waggoner
(74) *Attorney, Agent, or Firm* — MARSHALL, GERSTEIN & BORUN LLP

(57) ABSTRACT

Systems and methods for contactless pickup at a vending machine are provided. The systems and methods include determining that a user device is in proximity of the vending machine. The proximity is determined without the user touching an input mechanism of the vending machine. Responsive to determining the proximity, the vending machine or the user device transmits a request to vend the items included in a reservation to a management server. The management server then transmits a vend request to the vending machine which then vends the reserved items.

20 Claims, 6 Drawing Sheets

SYSTEMS AND METHODS FOR CONTACTLESS PICKUP AT A VENDING MACHINE

CROSS-REFERENCE TO RELATED APPLICATIONS

This application claims priority to U.S. Provisional Patent Application No. 63/048,960 entitled "Systems and Methods for Contactless Pickup at a Vending Machine" and filed on Jul. 7, 2020, the entirety of which is incorporated by reference herein.

FIELD OF THE DISCLOSURE

The present disclosure generally relates to systems and method of contactless pickup of items at a vending machine, and, more particularly, to vending machines that coordinate the contactless pickup with a vending machine management server.

BACKGROUND

Conventionally, vending machines require manual interactions to vend an item. To this end, the user is generally required to use a keypad or a touchscreen to indicate a desired selection of items to vend. However, these keypads and touchscreens are used by many different users during operation. Thus, there is a significant risk of transmission of contact-based viruses and/or diseases. Accordingly, there is a need for contactless pickup at a vending machine to mitigate the risk associated with contact-based transmission of viruses and/or diseases.

SUMMARY

The present disclosure relates to a vending machine that supports contactless pickup of items that have been vended by the vending machine. Consequently, a user does not need to interact with any input devices built into the vending machine itself to vend the items stored therein.

According to certain aspects, the vending machine is communicative coupled to an management server configured to perform inventory management for a network of vending machines. As such part of the inventory management capabilities, the management server includes a user-facing interface that enables users to reserve items at a vending machine before the user is physically proximate to the vending machine. For example, the user-facing interface may include a website or an application via which a user can interact to place a reservation. Because the vending machine inventory is centrally-maintained, the accurate inventory data can be provided via the user-facing interface. Accordingly, the user is able to place a reservation via the user-facing interface without contacting an input device of the vending machine. A vending machine reservation system is disclosed by co-owned U.S. patent application Ser. No. 16/267,039, the entire disclose of which is hereby incorporated by reference.

According to aspects, the vending machine is configured to store a database of reservations for items offered via the vending machine. Thus, the vending machine is able to reference this reservation database to contactlessly vend reserved items when the corresponding user arrives at the vending machine. Accordingly, techniques disclosed herein relate to detecting that the user corresponding to a reservation is proximate to the vending machine so that the vending machine can automatically vend the reserved items without the user contacting input devices of the vending machine.

In some embodiments, the vending machine is configured to display text code that uniquely corresponds to the vending machine. Accordingly, when the user arrives at the vending machine, the user is able to enter the text code into an application executing on their user device. The application then sends a message to the management server that includes the text code to inform the management server that the user is proximate to the vending machine. To ensure that the user is actually proximate to the vending machine, and does not just store a text code from a prior visit, the vending machine, in conjunction with the management server, may change the displayed text code periodically (e.g., every 5 minutes, every 15 minutes, every half hour, every hour, and so on). It should be appreciated in some conventional systems, the vending machine operators affix a static sticker to the vending machine that displays a text code. However, these conventional systems cannot distinguish between past users of the vending machine and users that are actually proximate to the vending machine.

In some other embodiments, the vending machine includes a BLUETOOTH® ("Bluetooth") transceiver configured to broadcast an identifier of the vending machine. The identifier may be formatted in a particular way such than when a user device that has the application executing thereon detects the Bluetooth broadcast, the application interprets the identifier to determine the identity of the vending machine. For example, the identifier may begin with a prefix that identifies the vending machine as belonging to the network of vending machines that is managed by the management server followed by a unique identifier corresponding to the vending machine. Accordingly, when the user arrives at the vending machine, the application automatically presents an alert that they are proximate to the vending machine. As such, the user experience of the contactless pickup is streamlined such that the user just needs to interact with the alert to contactlessly vend their reserved items. Moreover, in embodiments where the vending machine is at a location with multiple vending machines, the alert may be formatted to inform the user as to which vending machine the reservation was placed to further reduce confusion with the contactless pickup process.

Due to the inventory management system enabling a reservation process that is not tied to being physically present at the vending machine, users may show up at the wrong vending machine to pick up their reserved items. Accordingly, the vending machine may be configured to determine whether or not the reservation corresponding to the user device and/or the user is actually reserved at the vending machine. If the reservation was placed for another vending machine, the vending machine may then determine whether or not the reservation can be otherwise fulfilled based on current inventory levels and, if so, present an option to vend the reservation any way. As a result, even if a user shows up at the wrong vending machine, the vending machine is able to still contactlessly vend the reserved items.

Additional objects, advantages and improved features may become apparent to those skilled in the art upon examination of the following description and the accompanying drawings or may be learned by production or operation of the described examples.

DETAILED DESCRIPTION

Figure 1:
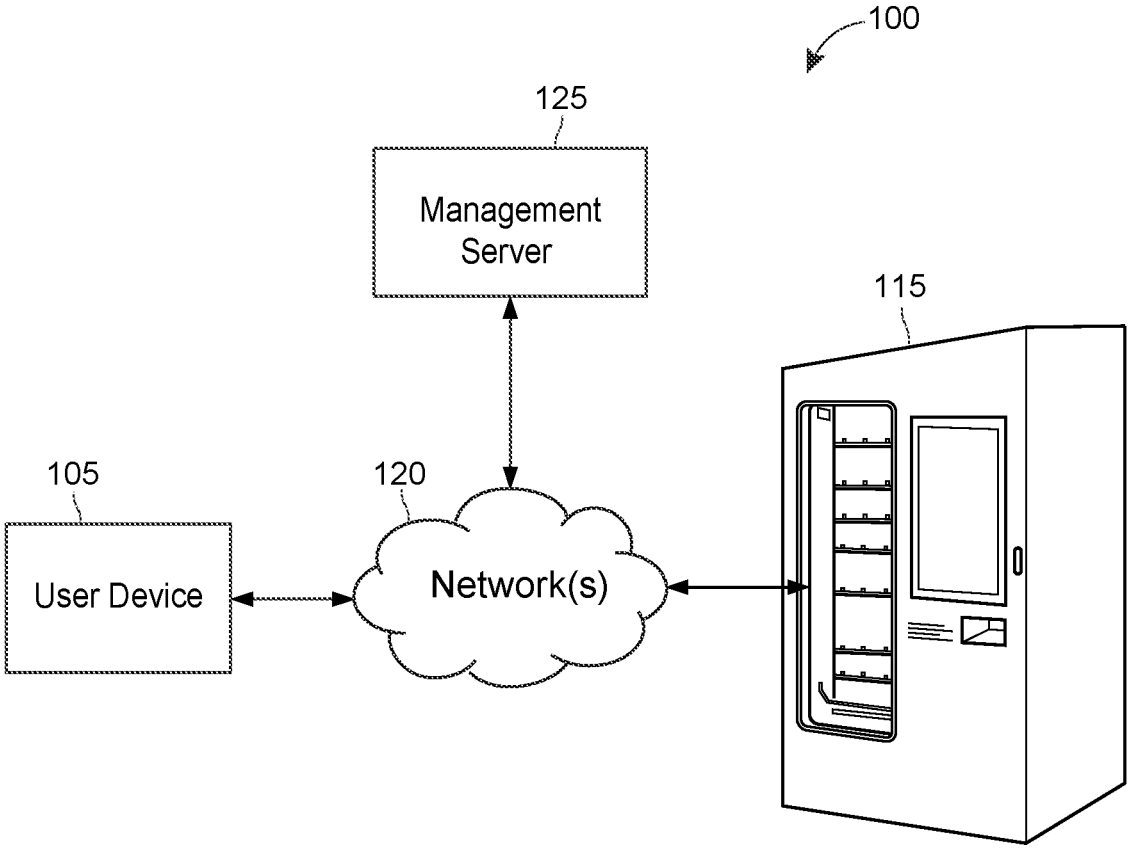
FIG. 1 illustrates an example vending machine network in which the present techniques are implemented.

Referring to the figures in detail, FIG. 1 illustrates an example vending machine network 100 for a network of vending machines 115 in which the present techniques are implemented. As illustrated, the network of vending machine network 100 may include individual vending machines 115 and user devices 105 connected to a management server 125 via a network 120. Although, FIG. 1 only illustrates the vending machine 115 and the user device 105, the vending machine network 100 may include any number of additional vending machines 115 and user devices 105. Each vending machine 115 may be a self-service unit that combines electro-mechanical dispensing components, temperature control components, network connectivity, and a user interface for customer interaction. In some locations, the network of vending machines 100 may include multiple vending machines 115 in the same location, e.g., in a side-by-side position.

The vending machine network 100 may include any suitable type of vending machine 115. For example, the vending machines 115 may include a storage system for holding individual food products for purchase. The storage system may include a plurality of slots adapted to store a plurality of individually dispensable products loaded therein. The slots may be substantially horizontal, such as embodiments that include a conveyor belt, shelf, or coil, or substantially vertical. In an example, each individual storage unit of the slot is associated with a sensor and/or a slot location identifier.

The vending machines 115 may also include an atmospheric control system that includes a variety of sensors and controllers for temperature, air composition, and/or humidity control. The temperature control components may include a cooling or refrigerating apparatus, a heating or warming apparatus, and/or other temperature control apparatuses to maintain a desired temperature associated with the items stored therein. For example, some fresh foods are best stored between 35-40° F. (1.66-4.44° C.). In some embodiments, the vending machines 115 include different temperature control apparatus to regulate the temperature of different slots. A temperature control apparatus may include one or more sensors to provide feedback to a regulator of the temperature control apparatus.

The vending machines 115 may also include a point of sale system. In some embodiments, the point of sale system includes one or more mechanisms to receive a customer selection of a particular item. For example, the selection mechanisms may include one or more buttons and/or a touchscreen display. Additionally, the point of sale system of the vending machine 115 may include a payment system adapted to receive and/or process cash, gift cards, promotions, customer account credits, and/or credit cards. The vending machines 15 may also include a merchandise selector including a user interface, key pad, and/or switches for customers to select the desired item for purchase. It should be appreciated that the contactless pickup techniques described herein cause the vending machine 115 to vend items stored therein without the user interacting with the point of sale system (and/or the selection mechanisms or payment systems thereof).

In some embodiments, the inventory control system of the vending machine 115 is configured to dynamically monitor inventory within the particular vending machine 115. In one example, the inventory control system of the vending machine 115 synchronizes inventory data with the management server 125 to maintain a central record of the inventory. In this example, the inventory update may include a sale record associated with the change in inventory. In some embodiments, the vending machine 115 monitors the inventory based on a sensor associated with the various item slots. When an item is purchased, the inventory control system detects corresponding sensor data that indicates that the item is no longer within the vending machine 115. In other embodiments, the inventory control system monitors transaction data from the point of sale system to update an inventory record accordingly. According to aspects, the transaction data may also include customer data such as demographic data, customer profile information, addressing information (including an identity and/or address of a customer electronic device), and so on.

In some embodiments, the vending machine 115 includes one or more systems to detect that the user device 105 is proximate to the vending machine. For example, the vending machine 115 may include hardware-based proximity detection means, such as one or more of a Bluetooth transceiver, a Wi-Fi transceiver, an RFID transceiver, a NFC transceiver, or a barcode reader. Additionally or alternatively, the vending machine 115 may include software-based proximity detection means, such as computer-executable instructions configured to cause the user interface of the vending machine 115 to display a text string or a barcode (including QR codes and GS1 codes) that uniquely corresponds to the vending machine 115.

As illustrated in FIG. 1, the vending machine 115 is in communication with the management server 125 via the network 120. The network 120 may facilitate any type of data communication via any current or future-developed standard or technology (e.g., GSM, CDMA, TDMA, WCDMA, NR, LTE, EDGE, OFDM, GPRS, EV-DO, UWB, IEEE 802 including Ethernet and Wi-Fi, WiMAX, Bluetooth, RS-232 serial communications, and others). In some embodiments, the network 120 utilizes two or more of the communication standards or technologies. For example, a first vending machine 115 may communication with the management server 125 via a IEEE 802 connection and a second vending machine 115 may communication with the management server 125 via a LTE connection.

In some embodiments, the user device 105 executes an application configured to interact with features of the management system 125 and/or the vending machine 115. The user device 105 may be any portable electronic device that supports user interactions and the ability to communicate over the networks 120. For example, the user device 105 may be a smartphone, a laptop, a tablet, a phablet, a smart watch, smart glasses, wearable electronics, and so on. In some embodiments, the user device 105 supports voice-based interactions for obtaining indications user inputs that control operation of the application. In some scenarios, the application is a dedicated application for interacting with the features of the management server 125. In other scenarios, the application is a browser application executing instructions associated with a website tailored to support the features of the management server 125.

As described herein, the management server 125 may be adapted to receive reservation requests from client devices (e.g., the user device 105, desktop computers, voice assistant devices, etc.) for items located at the vending machine 115. Accordingly, in response to receiving a reservation request for an item at the vending machine 115, the management server 125 may transmit a reservation request to the vending machine 105. As such, the vending machine 115 includes a reservation database configured to store reservation requests for items offered at the vending machine 115. It should be appreciated that while the client device via which the user made the reservation may be the user device 105, this is not required. For example, a user may make a reservation via their home office computer, whereas the vending machine 115 may be configured to detect the proximity of the user's mobile phone (e.g., the user device 105).

Accordingly, the application executing on the user device 105 may be configured to interface with the proximity detection means of the vending machine 115. For example, the application may be configured to obtain image data indicative of a barcode displayed on the user interface of the vending machine 115. As another example, the application may include a text entry field for receiving a text string displayed on the user interface of the vending machine 115. As yet another example, the application may interface with a Bluetooth, RFID, NFC, and/or Wi-Fi transceiver to detect the presence of the Bluetooth, RFID, NFC, and/or Wi-Fi transceiver of the vending machine 115.

It should be appreciated that other devices may be connected the management server 125 and/or the vending machine 115 via the network 120. For example, inventory management personnel may remove expired and/or otherwise unsellable items from the vending machine 115. Accordingly, when the vending machine 115 detects the presence of an inventory manager device (not depicted) proximate to the vending machine 115 via the disclose proximity detection means, the vending machine 115 and/or the inventory manager device may send a message to the management server 125, which, in turn, transmits an instruction to the vending machine 115 that causes the vending machine 115 to automatically unload the unsellable items.

Example Vending Machine

Figure 2:
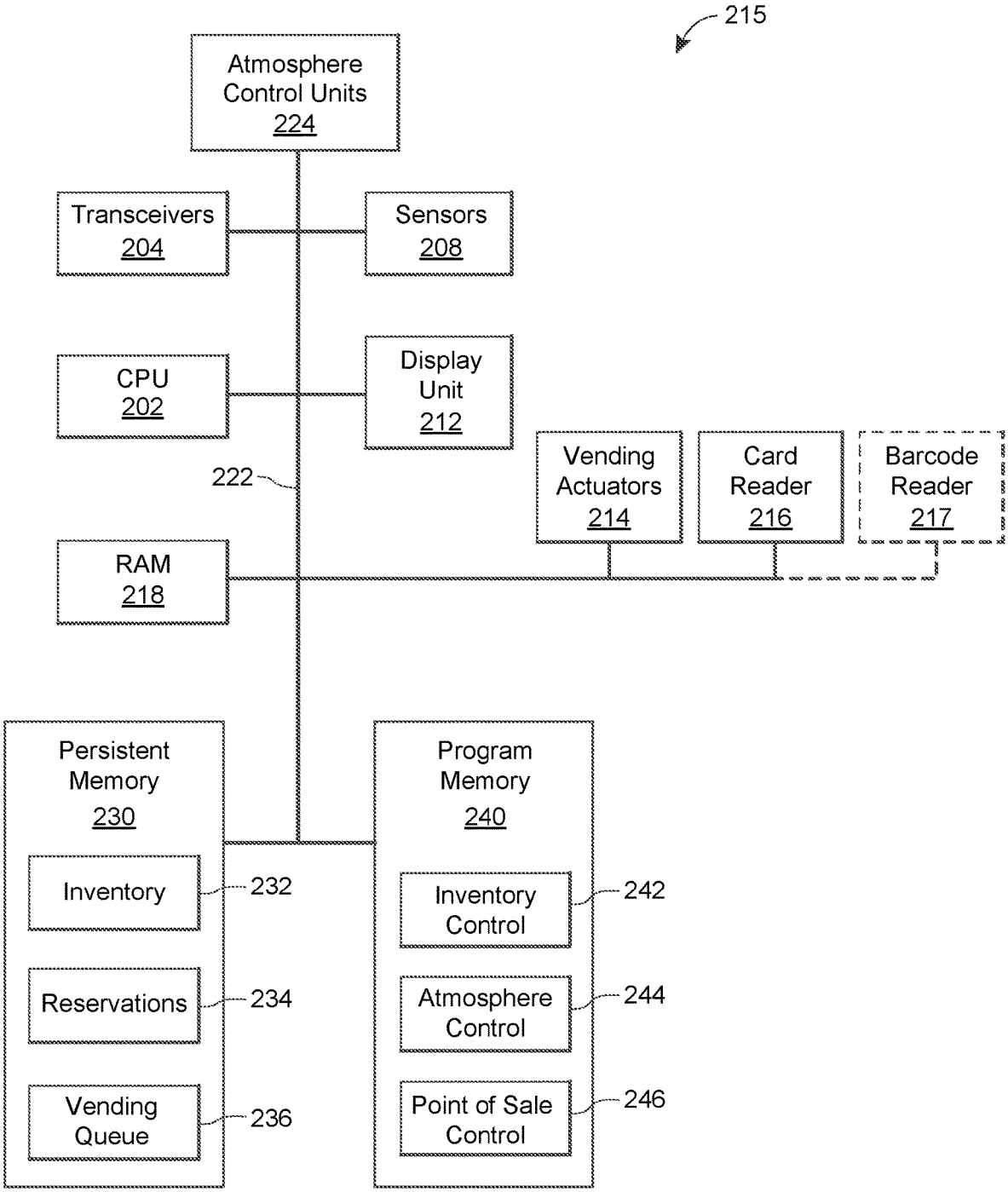
FIG. 2 is a block diagram of an example vending machine that may be used in the example system of FIG. 1.

Turning to FIG. 2, illustrated is an example vending machine 215, such as the vending machine 115 of FIG. 1, at which functionality described herein is implemented. The vending machine 215 may include transceivers 204 that enable the vending machine 215 to exchange data over a wireless or wired network (such as the network 120 described with respect to FIG. 1) with, for example, a management server (such as the management server 125 described with respect to FIG. 1). The transceivers 204 may include one or more transceivers (e.g., WWAN, WLAN, WPAN, EVDO, CDMA, GSM and/or LTE transceivers) functioning in accordance with IEEE standards, 3GPP standards, or other standards.

The vending machine 215 includes one or more processors, such as the depicted central processing unit (CPU) 202. Although not depicted, the vending machine 215 may also include a graphics processing unit (GPU). During operation, the CPU 202 executes instructions stored in a program memory module 240 coupled to the CPU 202 via a system bus 222. In some implementations, the program memory module 240 is implemented in a random access memory (RAM) module 218, a persistent memory module 230, or both. The program memory module 240 may also store computer-readable instructions that regulate the operation of the vending machine 215.

One set of instructions may be an inventory control application 242 that contains instructions to facilitate inventory control functionality. For example, the inventory control application 242 may maintain an accurate record of the various items stored at the vending machine 215. This record may be maintained at the inventory database 232 of the persistent memory 230. The records in the inventory database 232 may include indications of an item identifier, a stock keeping unit (SKU) identifier, a location (such as a slot identifier), expiration data, an item status (e.g., available, reserved, expired, locked, sold, etc.), and so on. In some embodiments, the inventory database 232 also includes SKU-based records that include indications of SKU quantity, a cost, SKU status (e.g., normal, recalled, promoted, stocked out, etc.). The SKU-based records may be automatically update in response to changes to item records. For example, when the inventory control application 242 updates an item record to indicate that a particular item has been sold and/or reserved, the SKU-record may automatically decrement a quantity parameter.

The inventory control application 242 may also be configured to manage reservations for items stored at the vending machine 215. To this end, when the inventory control application 242 receives a reservation request from a management server via the transceivers 204, the inventory control application 242 may create and/or maintain a record in the reservation database 234 of the persistent memory 230. The reservation record may include a list of reserved items, a reservation identifier, a user and/or user device identifier, and/or other information associated with the reservation.

The program memory 240 may also include a set of instructions that comprises a point of sale control application 246 configured to support the ordering of items and the processing of payments at the vending machine 215. The point of sale control application 246 may be configured to cause a display unit 212 to present one or more interfaces that guide a customer through the purchase process. The display unit 212 may include a touch-screen display for receiving user input. In some embodiments, the point of sale control application 246 may query the inventory database 236 to populate the interfaces with indications of the available inventory. As part of the payment process, the point of sale control application 246 monitors inputs at a card reader 216 to detect credit card information for completing the purchase.

It should be appreciated that the contactless pickup techniques described herein do not involve the user touching the display unit 212 and/or the card reader 216. In some embodiments, the transceivers 204 also include additional transceivers to detect the proximity of user devices (such as the user device 105 as described with respect to FIG. 1). For example, the transceivers 204 may include a Bluetooth transceiver configured to support Bluetooth-based (including Bluetooth Low Energy (BLE)-based) proximity detection techniques, a near field communication (NFC) transceiver configured to support NFC-based proximity detection techniques, a Wi-Fi transceiver configured to support Wi-Fi-based (including Wi-Fi direct-based) proximity detection techniques, a radio frequency identification (RFID) transceiver configured to support RFID-based proximity detection techniques, and/or other transceivers configured to support other proximity detection techniques. In some embodiments, the vending machine includes a barcode reader configured to detect and decode a barcode (including QR codes and GS1 codes), such as those depicted on a display of a user device.

As illustrated in FIG. 2, the inventory control application 242 may also control vending actuators 214 to vend a particular item. It should be appreciated that in other embodiments, control of the vending actuators 214 is processed by a separate application. The vending actuators 214 may be any actuator that controls a vending mechanism (e.g., a coil, a conveyor belt, a motorized shelf, a grabbing arm, a suction unit, etc.). In some embodiments, the vending actuators 214 include a separate controller configured to interpret control signals generated by the inventory control application 242 and transmitted over the system bus 222. For example, in response to detecting a purchase event for a Napa salad, the inventory control application 242 may query the inventory database 232 to identify a slot that stores a Napa salad and generate a vending command that indicates the slot identifier.

In response to detecting a command to vend an item (e.g., in response to a user completing a purchase via the display unit 212 or in response to receiving a vend request from the management server) the inventory control application 242 creates a corresponding record in a vending queue 236 for the command. The records in the vending queue 236 may include an indication of a list of items, a reservation identifier, a user identifier, and/or other information related to the vend request. By maintaining the vending queue 236, multiple users can interact with their respective user devices to request that their reserved items are vended without waiting for the vending machine 215 to complete a vending operation. As an example, if a first user is interacting with the display unit 212, a second user can issue a vend request at the same time. In some embodiments, the inventory control application 242 may be configured to prioritize the contactless pickup user and place the contactless pickup vending record in the vending queue 236 before the display unit customer completes an order. This reduces the overall vending time by starting the vending process sooner. In other embodiments, the inventory control application prioritizes the display unit customer by not placing the contactless pickup order into the vending queue 236 until after the display unit user's order is completed. This reduces confusion for the display unit customer associated with the vending machine 215 beginning to vend items mid-order.

When there is a record in the vending queue 236, the inventory control application 242 may identify the item(s) indicated by the record at the front of the queue and control the corresponding vending actuators 214 to vend the indicated items. If the vending queue 236 has multiple records therein, the inventory control application 242 may configure the display unit 212 to indicate an identifier associated with the vending record currently being vended.

In addition to programs, the RAM module 218 and the persistent memory module 230 may store data in a volatile or non-volatile mode, respectively. The RAM module 218 and the persistent memory module 230 further include one or more forms of fixed and/or removable memory, such as read-only memory (ROM), electronic programmable read-only memory (EPROM), RAM, erasable electronic programmable read-only memory (EEPROM), and/or other hard drives, flash memory, MicroSD cards, and others. For example, the inventory database 232, the reservation database 234, and the vending queue 236 may be stored as data structures in the persistent memory module 230.

It should be appreciated that the vending machine 215 may include additional or fewer components than what is depicted by FIG. 2. For example, the vending machine 215 may include keys, mice, buttons, or other physical input devices to facilitate user interactions with the vending machine 215. As another example, the vending machine 215 may include one or more external ports or other components that enable service personnel to interact with the vending machine 215, such as a USB or other port via which a service electronic device can be connected to transmit diagnostic messages for troubleshooting and/or maintenance activities. As yet another example, the vending machine 215 may include one or more cameras, scanners, or other sensors connected to track the items stored at the vending machine 215 and/or to support security surveillance, stock monitoring, scanning customer electronic devices, customer biometric recognition, and/or gesture-based reservation pickup, for example.

Contactless Pickup

Figure 3:
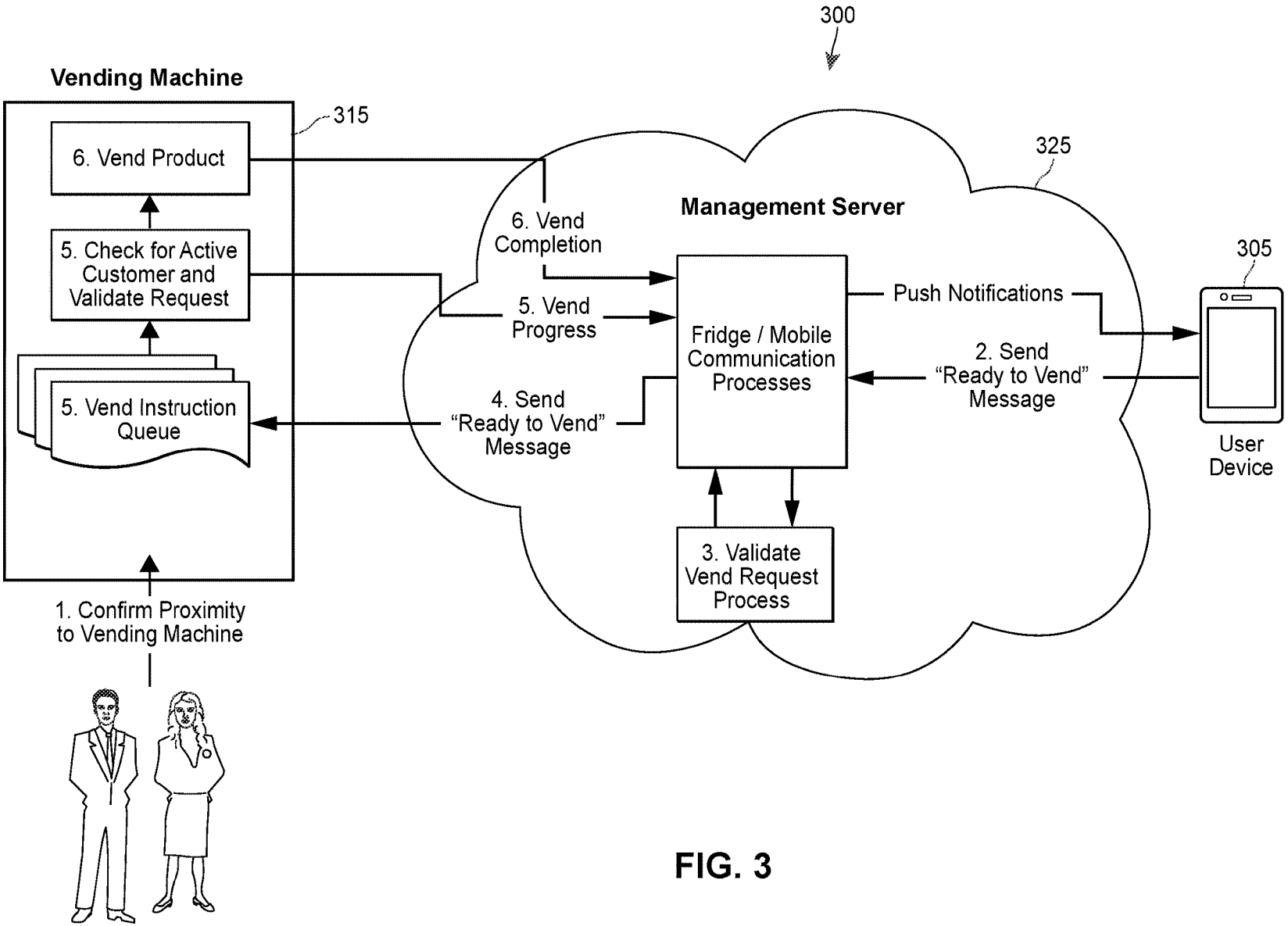
FIGS. 3 and 4 are flow diagrams indicative of contactless pickup processes that may be implemented vending machines of FIGS. 1 and 2.

FIG. 3 illustrates an example process flow 300 for a contactless pickup process implemented, in one embodiment, by a vending machine network (such as the vending machine network 100) that includes a vending machine 315 (such as the vending machines 115 or 215), a user device (such as the user device 105), and a management server (such as the management server 125). While FIG. 3 illustrates the management server 325 as a cloud computing systems, other server architectures are envisioned. Prior to the contactless pickup process beginning, the user reserved an item stored at the vending machine 315 using a client device.

The process flow 300 may begin at step (1) when the vending machine 315 and/or the user device 305 confirms their proximity to one another. For the process flow 300, the vending machine implements software-based techniques to confirm the proximity between the vending machine 315 and the user device 305. As such, the vending machine 315 does not include additional hardware components (e.g., additional transceivers 204 or the barcode reader 217) to detect the proximity of the user device 305.

As one example of a software-based technique, the vending machine 315 may display a text string that uniquely corresponds to the vending machine 315 via the display unit 212. The user may then interact with an application associated with the vending machine network to enter the displayed text string. The application causes the user device 305 to transmit the text string to the management server 325 such that management server 325 is able to confirm that the user is proximate to the vending machine 315 for which the reservation was made. Because a user of the user device 305 cannot see the text string until the user is proximate to the vending machine 315, the transmission of the text string to the management server 325 confirms the proximity of the user device 305 to the vending machine 315.

In this example, to prevent the user device 305 from storing the text string, the management server 325 may interact with the vending machine 315 to periodically change the text string that uniquely correspond to the vending machine 315. As such, if the user of the user device 315 transmits the same text string when picking up a subsequent reservation at the same vending machine 315, the management server 325 will determine that the user device 305 is not proximate to the vending machine 315.

As one example of a software-based technique, the vending machine 315 may display a barcode (including QR codes and GS1 codes) that uniquely corresponds to the vending machine 315 via the display unit 212. More particularly, the barcode may encode an identifier and/or a network location of an identifier that uniquely corresponds to the vending machine 315. The user may then interact with an application associated with the vending machine network to capture an image of the displayed barcode. In some embodiments, the application decodes the barcode to obtain the identifier. In these embodiments, the application then sends the decoded identifier to the management server 325 such that management server 325 is able to confirm that the user is proximate to the vending machine 315 for which the reservation was made. In other embodiments, the application transmits image data captured by the application to management server 325 for decoding at the management server 325.

In some embodiments, the vending machine is configured to display the text string and/or the barcode on a sleep or inactivity screen. As such, a user of the user device 305 can only confirm their proximity to the vending machine 315 when no one is currently interacting with the vending machine. This helps reduce the proximity of users to one another while interacting with the vending machine 315. In other embodiments, the display unit 212 dedicates a portion of the display screen to displaying the text string and/or the barcode even when a customer is interacting with the display unit 212. In still other embodiments, the vending machine 315 includes an auxiliary display unit for displaying the text string and/or the barcode. It should be appreciated that unlike the other embodiments, this may involve adding additional proximity detection hardware to the vending machine 315.

In some embodiments, the management server 325 may determine whether the vending machine is disposed in a location that includes multiple vending machines located in the same room and/or building. In these embodiments, the management server 325 may format the proximity confirmation message provided to the user device 305 to further include an indication of the relative position of the vending machine 315 as compared to other vending machines in the same room and/or building (e.g., "Your vending machine is the vending machine on the right").

Regardless, after the management server 325 confirms that the user device 305 is proximate to the correct vending machine 315, at step (2) of the process 300, the application may present a user interface that enables the user to send a "ready to vend" message to the management server 325. For example, the a user interface of the application may present an message indicating that successful proximity check and include a user interface element that, when selected, causes the user device 305 to transmit the "ready to vend message." The user interface may also include an indication of any vending machine position information included in the proximity confirmation message.

Upon receiving the "ready to vend" message, at step (3) of the process 300 the management server validates the vend request. Validation may include determining that the message came from the same source that just completed the proximity check at step (1), confirming that the vending machine 315 is in an operation stable and has a valid network connection and is able to receive a vend request, and/or that the reservation the user is attempting to vend is still valid (e.g., the user has not cancelled the order or the items are still available to vend). If the management server 325 is able to validate the vend request, the management server 325 may transmit a message to the user device 305 indicating that the request is being forwarded to the vending machine 315. If not, the management server 325 may instead transmit a corresponding error message to the user device 305. The messages transmitted to the user device 305 may be formatted in accordance with a push notification protocol implemented by the application.

At step (4) of the process 300, the management server sends the "ready to vend" message to the vending machine 315 for processing. The management server may format the "ready to vend" message to include a reservation identifier of the requested reservation to vend.

At step (5) of the process 300, the vending machine 315 process the "ready to vend" message. For example, the vending machine 315 may validate the "ready to vend" message. This may include confirming that the message came from an address that corresponds to the management server 325 and/or that a request timeout timer has not expired. After the vending machine 315 validates the "ready to vend" message, the vending machine 315 places the "ready to vend" message into the vending queue 236. In the example process 300, the vending machine 315 is configured not to vend items when a different customer is actively using the vending machine 315. Accordingly, in the example process 300, the vending machine 315 does not vend the reserved items until there is no active customer at the vending machine 315. In other examples, the vending machine 315 may begin processing the vending queue 236 even while there is an active customer. Regardless, as the vending machine 315 processes the vending queue 236, the vending machine 315 updates the management server 325 with the progress of each reservation and/or corresponding vending instruction thereof to similarly update the user device 305.

At step (6) of the process 300, the vending machine 315 removes the vend instruction from the vending queue 236 and controls the actuators 214 to vend the indicated items. Upon completion, the vending machine 315 transmits a vending complete message to the management server 325, which may then similarly update the user device 305.

Figure 4:
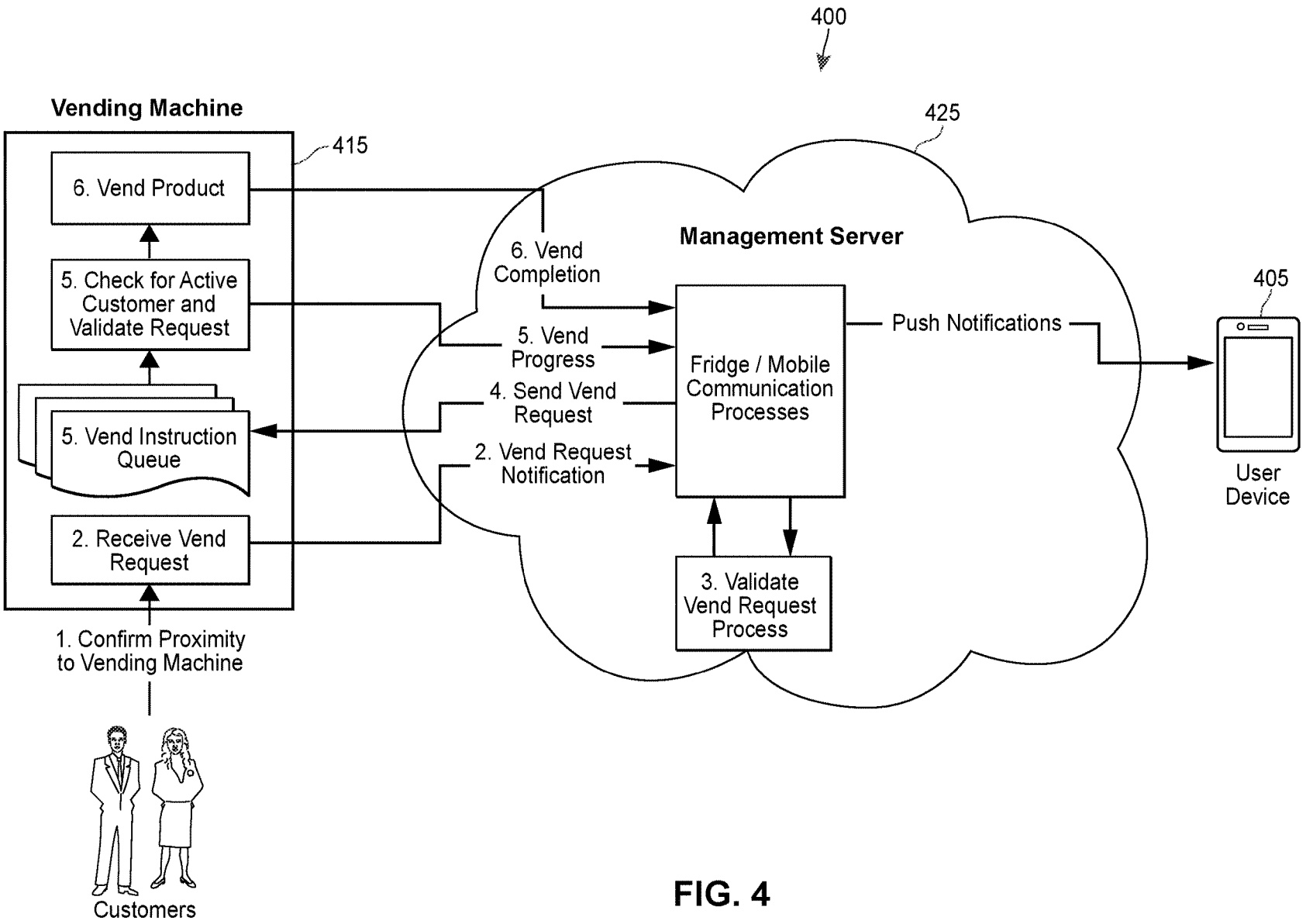

FIG. 4 illustrates an example process flow 400 for a contactless pickup process implemented, in one embodiment, by a vending machine network (such as the vending machine network 100) that includes a vending machine 415 (such as the vending machines 115, 215, 315), a user device (such as the user devices 105, 305), and a management server (such as the management servers 125, 325). While FIG. 4 illustrates the management server 425 as a cloud computing systems, other server architectures are envisioned. Prior to the contactless pickup process beginning, the user reserved an item stored at the vending machine 415 using a client device.

The process flow 400 may begin at step (1) when the vending machine 415 and/or the user device 405 confirms their proximity to one another. For the process flow 400, the vending machine implements hardware-based techniques to confirm the proximity between the vending machine 415 and the user device 405. As such, the dependency on network connectivity for user device 405 removed. Accordingly, the disclosed contactless pickup techniques may be implemented at vending machines 415 located in areas associated with poor mobile network coverage.

As one example of a hardware-based proximity detection technique, the vending machine 415 may include a barcode reader 217. In this example, the user may then interact with an application associated with the vending machine network to display a barcode corresponding to their reservation. For example, the displayed barcode may encode a reservation identifier. Accordingly, the user may hold the displayed barcode up to the barcode reader 217. The vending machine 415 then decodes the barcode to obtain the encoded reservation identifier and queries the reservation database 234 to determine that the encoded reservation identifier corresponds to a record therein.

As another example of a hardware-based proximity detection technique, the vending machine 415 may include a Bluetooth or Wi-Fi transceiver 204 configured to broadcast an identifier corresponding to the vending machine 415 Bluetooth or Wi-Fi transceiver (e.g., a Bluetooth device name or a service set identifier (SSID)). The identifier may be formatted such that the application executing on the user device 405 is able to determine that the vending machine 415 belongs to the network of vending machines. For example, the identifier may begin with a predetermined string. When the application detects the broadcast of the identifier, the application may cause the user device 405 to connect to the vending machine 405 via the Bluetooth or Wi-Fi transceiver. After establishing the connection, the application then causes the user device 405 to transmit, via the established connection, the reservation identifier to the vending machine 415. The vending machine 415 may then use the reservation identifier to query the reservation database 234 to determine that the received reservation identifier corresponds to a record therein.

As another example of a hardware-based proximity detection technique, the vending machine 415 may include NFC transceiver 204. Due to limited signal range of NFC communications, the vending machine 415 may include an indication of the location of the NFC transceiver 204 with respect to a housing of the vending machine 415. The user may then open the application associated with the vending machine network to enable the NFC transceiver of the user device 405. The user then brings the user device 405 near the NFC transceiver 204 such that the NFC transceiver is able to detect the user device 405. After establishing the NFC connection, the user device 405 may transmit the reservation identifier to the vending machine 415. The vending machine 415 may then use the reservation identifier to query the reservation database 234 to determine that the received reservation identifier corresponds to a record therein. A similar process may be performed if the vending machine includes an RFID transceiver 204.

In some scenarios, the vending machine 415 may determine that the user device 405 is proximate to the wrong vending machine in the network of vending machines (e.g., the reservation identifier does not correspond to a record in the reservation database 234). In these scenarios, the vending machine 415 may communicate with the management server 425 to determine a list of items included in the reservation. The vending machine 415 may then analyze the inventory database 232 to determine whether the vending machine 415 is capable of fulfilling the reservation.

If so, the vending machine 415 may be configured to transmit a notification to the user device 405 indicating that their order can be fulfilled at the vending machine 415. In some embodiments, instead of directly communicating the notification to the user device 405, the vending machine 415 transmits a notification to the management server 425, which, in turn, transmits a notification to the user device 405. In response to receiving the notification, the application may present the user with the option to vend the reservation at the vending machine 415. Upon the user selecting this option, the process 400 may proceed following steps (2) to (6) of the process 300. In other embodiments, if the vending machine 415 is capable of fulfilling the reservation, the management server 425 proceeds to step (3) of the process 400 without user intervention.

If vending machine 415 is unable to fulfill the reservation, the management server 425 may query its central inventory database to determine the capacity of vending machines near the vending machine 415 to fulfill the reservation. In some embodiments, the management server 425 transmits the list of nearby vending machines to the vending machine 415 to provide to the user device 405. In other embodiments, the management server 425 transmits the list of vending machines directly to the user device 405.

Regardless, after the vending machine 415 confirms that the user device 405 is proximate to the correct vending machine 415, at step (2) of the process 400, vending machine 405 may be configured to transmit a vend request to the management server 425. The vend request may indicate the reservation identifier and/or the list of items in the reservation to vend.

Upon receiving the vend request, steps (3) to (6) of the process 400 may proceed following in a similar manner as steps (3) to (6) of the process 300. If the management server 425 issued a vend request to the vending machine 415 for a reservation not stored in the reservation database 236 of the vending machine 415, the management server 425 may delete the copy of the reservation record from the reservation database 236 at the vending machine with which the reservation was originally associated.

Figure 5:
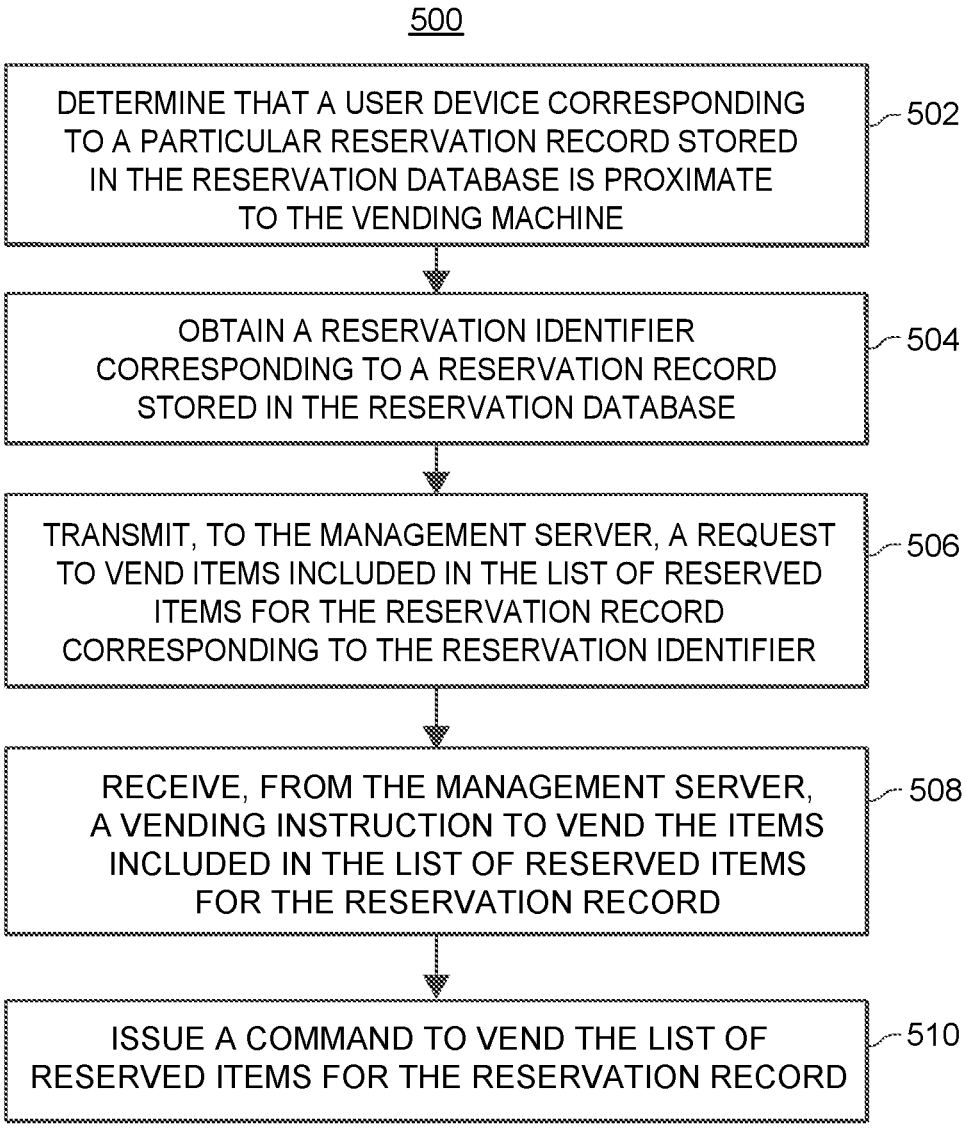
FIGS. 5 and 6 are flow diagrams of example methods for contactless pickup implemented at the example vending machine of FIGS. 1 and 2.

Referring now to FIG. 5, illustrated is a flow diagram of an example method 500 for an contactless pickup process implemented at a vending machine, such as the vending machines 115, 215, 315, and 415 of FIGS. 1-4, respectively. The method 500 may include actions described with respect to the process 400. The vending machine may be include (i) one or more processors; (ii) one or more transceivers adapted to communicate with a management server over a one or more communication networks (iii) a display unit; (iv) a reservation database configured to store reservation records of reservations for items available at the vending machine, wherein each reservation record includes a list of reserved items; and (v) one or more non-transitory memories coupled to the one or more processors, the reservation database, the display unit, and the one or more transceivers, the one or more non-transitory memories storing a set of computer executable instructions. To perform the method 500, the vending machine may execute the set of computer executable instructions stored at one or more non-transitory memories.

The method 500 begins at block 502 when the vending machine determines that a user device corresponding to a reservation record stored in the reservation database is proximate to the vending machine. As described herein, this determination occurs without the user touching the display unit. In embodiments where the vending machine is located at a location having two or more vending machines located thereat, responsive to determining that the user device is proximate to the vending machine the vending machine may be configured to transmit, to the user device, an indication of a position of the vending machine relative to another vending machine of the two or more vending machines. In some embodiments, transmitting the indication to the user device includes transmitting a notification to the management server which transmits the indication to the user device.

At block 504, the vending machine obtain a reservation identifier corresponding to the reservation record stored in the reservation database. In some embodiments, the vending machine includes a barcode reader. In these embodiments, block 502-504 may include the vending machine (i) detecting, via the barcode reader, a barcode; (ii) obtaining the reservation identifier by decoding to the barcode; and (iii) determining that the reservation identifier matches a reservation identifier corresponding to a reservation record stored in the reservation database.

In some embodiments, the vending machine includes a Bluetooth transceiver. In these embodiments, blocks 502-504 may include the vending machine (i) forming, via the Bluetooth transceiver, a Bluetooth connection with the user device; (ii) obtaining, via the Bluetooth transceiver, the reservation identifier; and (iii) determining that the reservation identifier matches a reservation identifier corresponding to a reservation record stored in the reservation database.

In some embodiments, the vending machine includes a NFC transceiver. In these embodiments, blocks 502-504 may include the vending machine (i) forming, via the NFC transceiver, a NFC connection with the user device; (ii) obtaining, via the NFC transceiver, the reservation identifier; and (iii) determining that the reservation identifier matches a reservation identifier corresponding to a reservation record stored in the reservation database.

In some embodiments, blocks 502-504 may include the vending machine presenting, via the display unit, a code corresponding to the vending machine and, responsive to a user device transmitting the code to the management server, receiving from the management server the reservation identifier associated with the user device. In some embodiments, the code is a barcode. In these embodiments, the user device may instead transmit an identifier encoded by the barcode to the management server.

At block 506, the vending machine transmits, to the management server, a request to vend items included in the list of reserved items for the reservation record corresponding to the reservation identifier. At block 508, the vending machine receives, from the management server, a vending instruction to vend the items included in the list of reserved items for the reservation record.

At block 510, the vending machine issues a command to vend the list of reserved items for the reservation record. In some embodiments, the vending machine includes a vending queue configured to store commands to vend the lists of reserved items stored in reservation records. In these embodiments, responsive to receiving the vending instruction, the vending machine may place the command in the vending queue and issue the command responsive to the command being obtained from the vending queue. In some embodiments, the vending machine may also provide an indications related to the vending queue to users For example, the vending machine may cause the display unit to present an indication of the reservation corresponding to the command, or transmit, to the user device, an indication of a queue position corresponding to the command.

As described herein, the vending machine may be configured to address users that arrived at the vending machine despite reserving items stored at a different vending machine. Accordingly, the vending machine may be further configured to (i) determine that a second user device that does not correspond to a reservation record stored in the reservation database is proximate to the vending machine; (ii) transmit, to the management server, a reservation identifier obtained from the second user device; and (iii) receive, from the management server, an indication of a second reservation record corresponding to the second user device.

As described herein, the vending machine may or may not be able to fulfill the second device's reservation. Accordingly, the vending machine may be configured to determine that the vending machine is capable of vending items included in a second list of items and transmit, to the second user device, a notification enabling the user of the second user device to vend items included in the second list of items at the vending machine. In some embodiments, transmitting the notification to the user device includes transmitting a notification to the management server which transmits the notification to the user device. Responsive to receiving, from the second user device, a request to vend the items included in the second list of items, the vending machine may be configured to transmit, to the management server, a request to vend items included in the second list of reserved items, wherein transmitting the request causes the management server to delete a copy of the second reservation record stored at a second vending machine.

Alternatively, the vending machine may be configured to determine that the vending machine is not capable of vending items included in the second list of items and transmit, to the management server, a request to provide, to the second user device, a list of vending machines that are (i) proximate to the vending machine (ii) capable of vending the items included in the second list of items.

Figure 6:
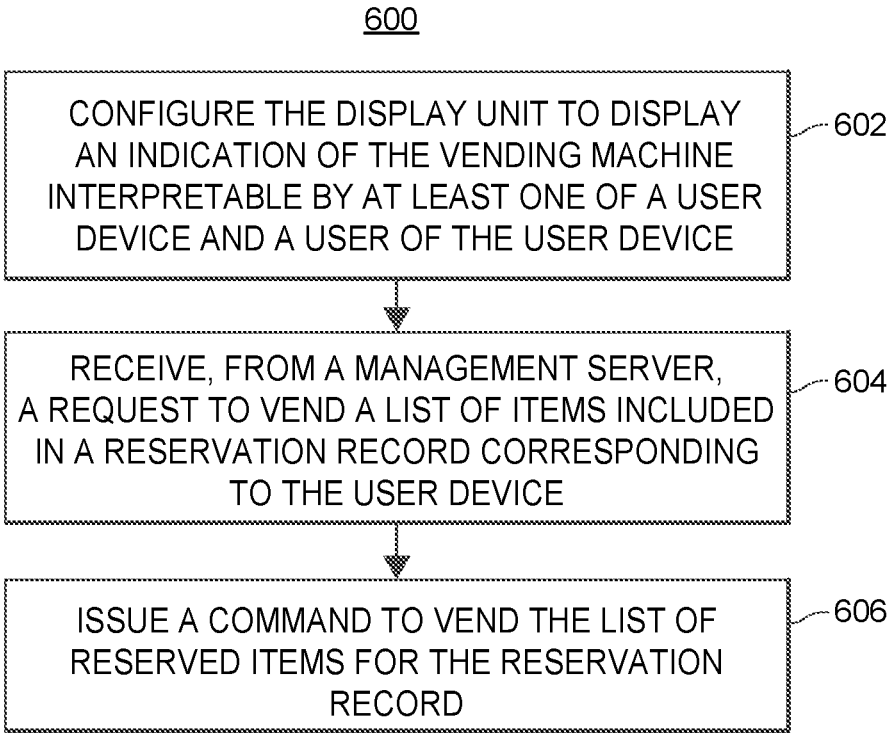

Referring now to FIG. 6, illustrated is a flow diagram of an example method 600 for an contactless pickup process implemented at a vending machine, such as the vending machines 115, 215, 315, and 415 of FIGS. 1-4, respectively. The method may include actions described with respect to the process 300. The vending machine may be include (i) one or more processors; (ii) one or more transceivers adapted to communicate with a management server over a one or more communication networks (iii) a display unit; (iv) a reservation database configured to store reservation records of reservations for items available at the vending machine, wherein each reservation record includes a list of reserved items; and (v) one or more non-transitory memories coupled to the one or more processors, the reservation database, the display unit, and the one or more transceivers, the one or more non-transitory memories storing a set of computer executable instructions. To perform the method 600, the vending machine may execute the set of computer executable instructions stored at one or more non-transitory memories.

The method 600 begins at block 602 when configure the display unit to display an indication of the vending machine interpretable by at least one of a user device and a user of the user device. For example the vending machine may display a text string that uniquely corresponds to the vending machine. In this example, the vending machine may periodically change the displayed text string that uniquely corresponds to the vending machine. As another example, the vending machine may display a barcode that encodes an identifier of the vending machine.

At block 604, the vending machine receives, from a management server, a request to vend a list of items included in a reservation record corresponding to the user device. The request may be received responsive to the user device transmitting, to the management server, a message based on the displayed indication of the vending machine. At block 606, the vending machine issues a command to vend the list of reserved items for the reservation record.

ADDITIONAL CONSIDERATION

As mentioned above, aspects of the systems and methods described herein are controlled by one or more controllers. The one or more controllers may be adapted to run a variety of application programs, access and store data, including accessing and storing data in the associated databases, and enable one or more interactions as described herein. Typically, the controller is implemented by one or more programmable data processing devices. The hardware elements, operating systems, and programming languages of such devices are conventional in nature, and it is presumed that those skilled in the art are adequately familiar therewith.

The one or more controllers may also include one or more input/output interfaces for communications with one or more processing systems. Although not shown, one or more such interfaces may enable communications via a network, e.g., to enable sending and receiving instructions electronically. The communication links may be wired or wireless.

The one or more controllers may further include appropriate input/output ports for interconnection with one or more output mechanisms (e.g., monitors, printers, touchscreens, motion-sensing input devices, etc.) and one or more input mechanisms (e.g., keyboards, mice, voice, touchscreens, bioelectric devices, magnetic readers, RFID readers, barcode readers, motion-sensing input devices, etc.) serving as one or more user interfaces for the controller. For example, the one or more controllers may include a graphics subsystem to drive the output mechanism. The links of the peripherals to the system may be wired connections or use wireless communications.

Although summarized above as a PC-type implementation, those skilled in the art will recognize that the one or more controllers also encompasses systems such as host computers, cloud computers, servers, workstations, network terminals, and the like. Further one or more controllers may be embodied in a device, such as a mobile electronic device, like a smartphone or tablet computer. In fact, the use of the term controller is intended to represent a broad category of components that are well known in the art.

Hence aspects of the systems and methods provided herein encompass hardware and software for controlling the relevant functions. Software may take the form of code or executable instructions for causing a controller or other programmable equipment to perform the relevant steps, where the code or instructions are carried by or otherwise embodied in a medium readable by the controller or other machine. Instructions or code for implementing such operations may be in the form of computer instruction in any form (e.g., source code, object code, interpreted code, etc.) stored in or carried by any tangible readable medium.

As used herein, terms such as computer or machine "readable medium" refer to any medium that participates in providing instructions to a processor for execution. Such a medium may take many forms. Non-volatile storage media include, for example, optical or magnetic disks, such as any of the storage devices in any computer(s) shown in the drawings. Volatile storage media include dynamic memory, such as the memory of such a computer platform. Common forms of computer-readable media therefore include for example: a floppy disk, a flexible disk, hard disk, magnetic tape, any other magnetic medium, a CD-ROM, DVD, any other optical medium, punch cards, paper tape, any other physical medium with patterns of holes, a RAM, a PROM and EPROM, a FLASH-EPROM, any other memory chip or cartridge, or any other medium from which a controller can read programming code and/or data. Many of these forms of computer readable media may be involved in carrying one or more sequences of one or more instructions to a processor for execution.

It should be noted that various changes and modifications to the embodiments described herein will be apparent to those skilled in the art. Such changes and modifications may be made without departing from the spirit and scope of the present invention and without diminishing its attendant advantages. For example, various embodiments of the systems and methods may be provided based on various combinations of the features and functions from the subject matter provided herein.

What is claimed is:

1. A vending machine comprising:

one or more processors;

one or more transceivers adapted to communicate with a management server over a one or more communication networks;

a display unit;

a reservation database configured to store reservation records of reservations for items available at the vending machine, wherein each reservation record includes a list of reserved items; and one or more non-transitory memories coupled to the one or more processors, the reservation database, the display unit, and the one or more transceivers, the one or more non-transitory memories storing a set of computer executable instructions that, when executed by the one or more processors, cause the vending machine to:

determine that a user device corresponding to a reservation record stored in the reservation database is proximate to the vending machine, wherein the determination occurs without the user touching the display unit;

obtain a reservation identifier corresponding to the reservation record stored in the reservation database;

transmit, to the management server, a request to vend items included in the list of reserved items for the reservation record corresponding to the reservation identifier;

receive, from the management server, a vending instruction to vend the items included in the list of reserved items for the reservation record;

issue a command to vend the list of reserved items for the reservation record.

2. The vending machine of claim 1, further comprising:

a barcode reader;

wherein the instructions, when executed, cause the one or more processors to:

detect, via the barcode reader, a barcode;

obtain the reservation identifier by decoding to the barcode; and determine that the reservation identifier matches a reservation identifier corresponding to a reservation record stored in the reservation database.

3. The vending machine of claim 1, further comprising:

a Bluetooth transceiver; and wherein to determine that the user device is proximate to the vending machine, the instructions, when executed, cause the one or more processors to:

form, via the Bluetooth transceiver, a Bluetooth connection with the user device;

obtain, via the Bluetooth transceiver, the reservation identifier; and determine that the reservation identifier matches a reservation identifier corresponding to a reservation record stored in the reservation database.

4. The vending machine of claim 1, further comprising:

a near field communication (NFC) transceiver; and wherein to determine that the user device is proximate to the vending machine, the instructions, when executed, cause the one or more processors to:

form, via the NFC transceiver, a NFC connection with the user device;

obtain, via the NFC transceiver, the reservation identifier; and determine that the reservation identifier matches a reservation identifier corresponding to a reservation record stored in the reservation database.

5. The vending machine of claim 1, wherein the instructions, when executed, cause the one or more processors to:

present, via the display unit, a code corresponding to the vending machine; and responsive to a user device transmitting the code to the management server, receive, from the management server, the reservation identifier associated with the user device.

6. The vending machine of claim 1, further comprising:

a vending queue configured to store commands to vend the lists of reserved items stored in reservation records;

wherein to issue the command to vend the list of reserved items, the instructions, when executed, cause the one or more processors to:

responsive to receiving the vending instruction, place the command in the vending queue issue the command responsive to the command being obtained from the vending queue.

7. The vending machine of claim 6, wherein to obtain the command from the vending queue, the instructions, when executed, cause the one or more processors to:

cause the display unit to present an indication of the reservation corresponding to the command.

8. The vending machine of claim 6, wherein to place the command in the vending queue, the instructions, when executed, cause the one or more processors to:

transmit, to the user device, an indication of a queue position corresponding to the command.

9. The vending machine of claim 1, wherein the instructions, when executed, cause the one or more processors to:

determine that a second user device that does not correspond to a reservation record stored in the reservation database is proximate to the vending machine;

transmit, to the management server, a reservation identifier obtained from the second user device; and receive, from the management server, an indication of a second reservation record corresponding to the second user device.

10. The vending machine of claim 9, wherein the instructions, when executed, cause the one or more processors to:

determine that the vending machine is capable of vending items included in a second list of items; and transmit, to the second user device, a notification enabling the user of the second user device to vend items included in the second list of items at the vending machine.

11. The vending machine of claim 10, wherein the instructions, when executed, cause the one or more processors to:

responsive to receiving, from the second user device, a request to vend the items included in the second list of items, transmit, to the management server, a request to vend items included in the second list of reserved items, wherein transmitting the request causes the management server to delete a copy of the second reservation record stored at a second vending machine.

12. The vending machine of claim 9, wherein the instructions, when executed, cause the one or more processors to:

determine that the vending machine is not capable of vending items included in the second list of items;

transmit, to the management server, a request to provide, to the second user device, a list of vending machines that are (i) proximate to the vending machine (ii) capable of vending the items included in the second list of items.

13. The vending machine of claim 1, wherein:

the vending machine is located at a location having two or more vending machines located thereat; and the instructions, when executed, cause the one or more processors to:

responsive to determining that the user device is proximate to the vending machine, transmit, to the user device, an indication of a position of the vending machine relative to another vending machine of the two or more vending machines.

14. A vending machine comprising:

one or more processors;

one or more transceivers adapted to communicate with a management server over a one or more communication networks;

a display unit;

a reservation database configured to store reservation records of reservations for items available at the vending machine, wherein each reservation record includes a list of reserved items; and one or more non-transitory memories coupled to the one or more processors, the reservation database, the display unit, and the one or more transceivers, the one or more non-transitory memories storing a set of computer executable instructions that, when executed by the one or more processors, cause the vending machine to:

configure the display unit to display an indication of the vending machine interpretable by at least one of a user device and a user of the user device;

receive, from a management server, a request to vend a list of items included in a reservation record corresponding to the user device, wherein the request is received responsive to the user device transmitting, to the management server, a message based on the displayed indication of the vending machine;

issue a command to vend the list of reserved items for the reservation record.

15. The vending machine of claim 14, wherein to configure the display unit to display the indication of the vending machine, the instructions, when executed, cause the vending machine to:

display a text string that uniquely corresponds to the vending machine.

16. The vending machine of claim 15, wherein the instructions, when executed, cause the vending machine to:

periodically change the displayed text string that uniquely corresponds to the vending machine.

17. The vending machine of claim 14, wherein to configure the display unit to display the indication of the vending machine, the instructions, when executed, cause the vending machine to:

display a barcode that encodes an identifier of the vending machine.

18. A computer implemented method implemented at a vending machine that includes (i) one or more processor, (ii) one or more transceivers adapted to communicate with a management server over a one or more communication networks, (iii) a display unit; and (iv) a reservation database configured to store reservation records of reservations for items available at the vending machine, wherein each reservation record includes a list of reserved items; the method comprising:

determining, via the one or more processors, that a user device corresponding to a reservation record stored in the reservation database is proximate to the vending machine, wherein the determination occurs without the user touching the display unit;

obtaining, via the one or more processors, a reservation identifier corresponding to the reservation record stored in the reservation database;

transmitting, to the management server, a request to vend items included in the list of reserved items for the reservation record corresponding to the reservation identifier;

receiving, from the management server, a vending instruction to vend the items included in the list of reserved items for the reservation record;

issuing, via the one or more processors, a command to vend the list of reserved items for the reservation record.

19. The computer implemented method of claim 18, wherein:

the vending machine includes a barcode reader; and the method includes:

detecting, via the barcode reader, a barcode;

obtaining, via the one or more processors, the reservation identifier by decoding to the barcode; and determining, via the one or more processors, that the reservation identifier matches a reservation identifier corresponding to a reservation record stored in the reservation database.

20. The computer implemented method of claim 18, wherein:

the vending machine includes a Bluetooth transceiver; and the method includes:

forming, via the Bluetooth transceiver, a Bluetooth connection with the user device;

obtaining, via the Bluetooth transceiver, the reservation identifier; and determining, via the one or more processors, that the reservation identifier matches a reservation identifier corresponding to a reservation record stored in the reservation database.

* * * * *